US008500424B2

(12) United States Patent
Feller et al.

(10) Patent No.: US 8,500,424 B2
(45) Date of Patent: Aug. 6, 2013

(54) SCREW COMPRESSOR WITH A SOUND DAMPENING DEVICE THAT SEPARATES LUBRICANT

(75) Inventors: Klaus Feller, Herrenberg (DE); Roni Loerch, Straubenhardt (DE)

(73) Assignee: Bitzer Kuehlmaschinenbau, Sindelfingen (DE)

( * ) Notice: Subject to any disclaimer, the term of this patent is extended or adjusted under 35 U.S.C. 154(b) by 72 days.

(21) Appl. No.: 13/015,736

(22) Filed: Jan. 28, 2011

(65) Prior Publication Data

US 2011/0182762 A1 Jul. 28, 2011

Related U.S. Application Data

(63) Continuation of application No. PCT/EP2009/058597, filed on Jul. 7, 2009.

(30) Foreign Application Priority Data

Jul. 29, 2008 (DE) ..... 10 2008 036 317

(51) Int. Cl.

| | |
|---|---|
| ***F01C 1/18*** | (2006.01) |
| ***F01C 1/24*** | (2006.01) |
| ***F04C 2/18*** | (2006.01) |
| ***F04C 2/24*** | (2006.01) |

(52) U.S. Cl.
USPC ..... 418/201.1; 418/205; 418/206.8; 418/206.9; 418/DIG. 1

(58) Field of Classification Search
USPC ..... 418/201.1, 206.8, 206.1, 205, 206.9, 418/DIG. 1
See application file for complete search history.

(56) References Cited

U.S. PATENT DOCUMENTS

| | | | | |
|---|---|---|---|---|
| 4,957,517 | A | 9/1990 | Linnert | |
| 6,004,119 | A * | 12/1999 | Hamasaki et al. | 418/206.1 |
| 6,364,645 | B1 * | 4/2002 | Dieterich | 418/201.1 |
| 2002/0054823 | A1 | 5/2002 | Hida et al. | |
| 2006/0243520 | A1 | 11/2006 | Hertenstein et al. | |
| 2008/0170957 | A1 | 7/2008 | Hwang et al. | |

FOREIGN PATENT DOCUMENTS

| | | | |
|---|---|---|---|
| DE | 4008882 | A1 | 10/1990 |
| DE | 19739279 | A1 | 3/1999 |
| DE | 10359032 | A1 | 7/2005 |
| EP | 0 277 583 | A2 | 8/1988 |
| EP | 1 936 201 | A2 | 6/2008 |
| GB | 1 508 212 | A | 4/1978 |
| GB | 2 033 247 | A | 5/1980 |
| WO | WO 2007/070039 | A1 | 6/2007 |

* cited by examiner

*Primary Examiner* — Mary A Davis
(74) *Attorney, Agent, or Firm* — Reinhart Boerner Van Deuren P.C.

(57) ABSTRACT

In order to improve a screw compressor comprising an outer housing, a compressor screw housing which is arranged in the outer housing and in which rotor bores for screw rotors are arranged, a drive arranged in the outer housing on one side of the compressor screw housing, a bearing housing arranged in the outer housing on a side of the compressor screw housing located opposite the drive and a sound damping device which is arranged within the outer housing and has compressed working medium flowing through it, in such a manner that the working medium leaving the screw compressor carries as little lubricant as possible along with it, it is suggested that the sound damping device guide the compressed working medium by means of a flow guide in an interior space as a circulating flow circulating around an axis and that lubricant be separated from the circulating flow of the working medium as a result of centrifugal forces.

20 Claims, 7 Drawing Sheets

SCREW COMPRESSOR WITH A SOUND DAMPENING DEVICE THAT SEPARATES LUBRICANT

CROSS-REFERENCE TO RELATED PATENT APPLICATIONS

This application is a continuation of international application number PCT/EP2009/058597 filed on Jul. 7, 2009.

This patent application claims the benefit of International application No. PCT/EP2009/058597 of Jul. 7, 2009 and German application No. 10 2008 036 317.0 of Jul. 29, 2008, the teachings and disclosure of which are hereby incorporated in their entirety by reference thereto.

BACKGROUND OF THE INVENTION

The invention relates to a screw compressor comprising an outer housing, a compressor screw housing which is arranged in the outer housing and in which rotor bores for screw rotors are arranged, a drive arranged in the outer housing on one side of the compressor screw housing, a bearing housing arranged in the outer housing on a side of the compressor screw housing located opposite the drive and a sound damping device arranged within the outer housing and having the compressed working medium flowing through it.

Screw compressors of this type are known from the state of the art, for example DE 103 59 032 A1.

The problem with these screw compressors is the fact that the compressed working medium leaving the screw compressor carries too much lubricant along with it, at least in some operating states.

The object underlying the invention is, therefore, to improve a screw compressor of the generic type in such a manner that the working medium leaving the screw compressor carries as little lubricant as possible along with it.

SUMMARY OF THE INVENTION

This object is accomplished in accordance with the invention, in a screw compressor of the type described at the outset, in that the sound damping device guides the compressed working medium by means of a flow guide in an interior space as a circulating flow circulating around an axis and that lubricant is separated from the circulating flow of the working medium as a result of centrifugal forces.

The advantage of the solution according to the invention is to be seen in the fact that it offers the possibility of already carrying out a separation of lubricant in the sound damping device and, in this respect, of already removing, in the sound damping device, a considerable portion of the lubricant carried along with the working medium as a result of separation without the space required being increased and without additional space being required for this first separation of lubricant.

In this respect, it is particularly advantageous when lubricant is separated from the circulating flow of the working medium in the area of the flow guide, i.e. the lubricant carried radially outwards by centrifugal forces is separated at the flow guide.

The flow guide could, in principle, be formed from a series of consecutive but separate flow conducting elements.

A simple and advantageous design provides, however, for the flow guide to be designed as a wall which encloses the interior space and at which the separation of lubricant takes place.

In order to be able to discharge the lubricant, which is separated at the flow guide, from the interior space in a simple manner such that it can no longer be carried along by the circulating flow, it is preferably provided for the flow guide to have openings for the lubricant.

In principle, it would be conceivable to provide the entire flow guide with openings of this type.

However, in order to allow as little working medium as possible to pass through the openings from the interior space, it is preferably provided for the openings to be arranged in individual areas of the flow guide.

One advantageous possibility provides for the openings to be arranged in the flow guide in the form of at least one field of openings, wherein the field of openings comprises a plurality of openings which are arranged relative to one another, for example, in a specific pattern.

In the simplest case, it is conceivable for the flow guide to be provided with at least two fields of openings.

The fields of openings could be arranged next to one another in the direction of the axis.

It is, however, even more advantageous when the fields of openings are arranged so as to follow one another in circumferential direction.

In order to prevent an appreciable amount of the working medium from still flowing through the openings of the fields of openings, it is preferably provided for the flow guide to be covered with a material pervious to lubricant in the area of the openings on a side facing away from the interior space.

Such a material pervious to lubricant serves the purpose of reducing the flow of working medium through the openings.

The material pervious to lubricant can be designed in the most varied of ways. For example, it could be a porous material.

One advantageous development provides, however, for the material pervious to lubricant to be a fiber material, for example a felt-like, knit-like or weave-like material consisting, in particular, of metal wires or metal fibers.

In order to reduce the flow through the material pervious to lubricant to a considerable extent, it is preferably provided for the material pervious to lubricant to be covered by an outer wall of the housing of the sound damping device on its side facing away from the flow guide.

One particularly expedient embodiment provides for the material pervious to lubricant to be built up such that it prevents any flow of working medium through it, i.e. the material pervious to lubricant allows lubricant to pass through it, for example, on account of the capillary effect but is finely structured in such a manner that any flow of working medium through it is suppressed to a great extent.

The material pervious to lubricant is preferably arranged in the intermediate space between the outer wall and the inner wall.

The outer wall results, in particular, in the fact that the material pervious to lubricant can have lubricant flowing through it not only transversely but that it is also necessary for lubricant to flow through it, in addition, in circumferential direction.

The outer wall is preferably provided with passages, through which the lubricant can exit from the housing of the sound damping device, for the purpose of discharging the lubricant.

With respect to the further construction of the screw compressor according to the invention, no additional details have so far been given.

One advantageous solution, for example, provides for an inlet flow to enter the sound damping device transversely to the axis.

As a result, the inlet flow can be redirected by the flow guide into the circulating flow already described in a simple manner.

Such an inlet flow can preferably be generated in that the sound damping device has an inlet channel which allows the working medium to enter the interior space in the form of the inlet flow running transversely to the axis.

In order to be able to realize the space-saving mode of construction, it is expediently provided for the inlet channel to have a section which extends in an inlet connection piece approximately in the direction of the axis.

Furthermore, it is preferably provided for the inlet channel to extend in a curved manner in an arc of the inlet pipe.

Furthermore, it is preferably provided for the inlet channel to be arranged outside a central area of the interior space, i.e., in particular, on one side of the axis.

Furthermore, no further details have likewise been given with respect to the exiting of the working medium in the case of the sound damping device according to the invention.

One advantageous solution provides, for example, for the working medium to exit from the sound damping device in the form of an outlet flow running approximately in the direction of the axis.

In particular, the outlet flow runs for this purpose through an outlet pipe provided for it.

In this respect, the outlet pipe is expediently arranged in a central area relative to the flow guide, preferably arranged such that it has the axis passing through it.

In a particularly favorable case, it is provided for the outlet pipe to be arranged coaxial to the axis.

In addition, the outlet pipe is preferably designed such that it has an inner opening and an outer opening, wherein the inner opening opens into the interior space and the outer opening opens into a space surrounding the sound damping device, for example an interior space of a housing capsule of the outer housing.

In this respect, a jump in the cross section of at least a factor of 2, preferably more, which is necessary for the sound damping effect of the outlet pipe, is expediently brought about not only in the region of the inner opening but also in the region of the outer opening.

Additional features and advantages of the invention are the subject matter of the following description as well as the drawings illustrating one embodiment.

DETAILED DESCRIPTION OF THE INVENTION

Figure 1:
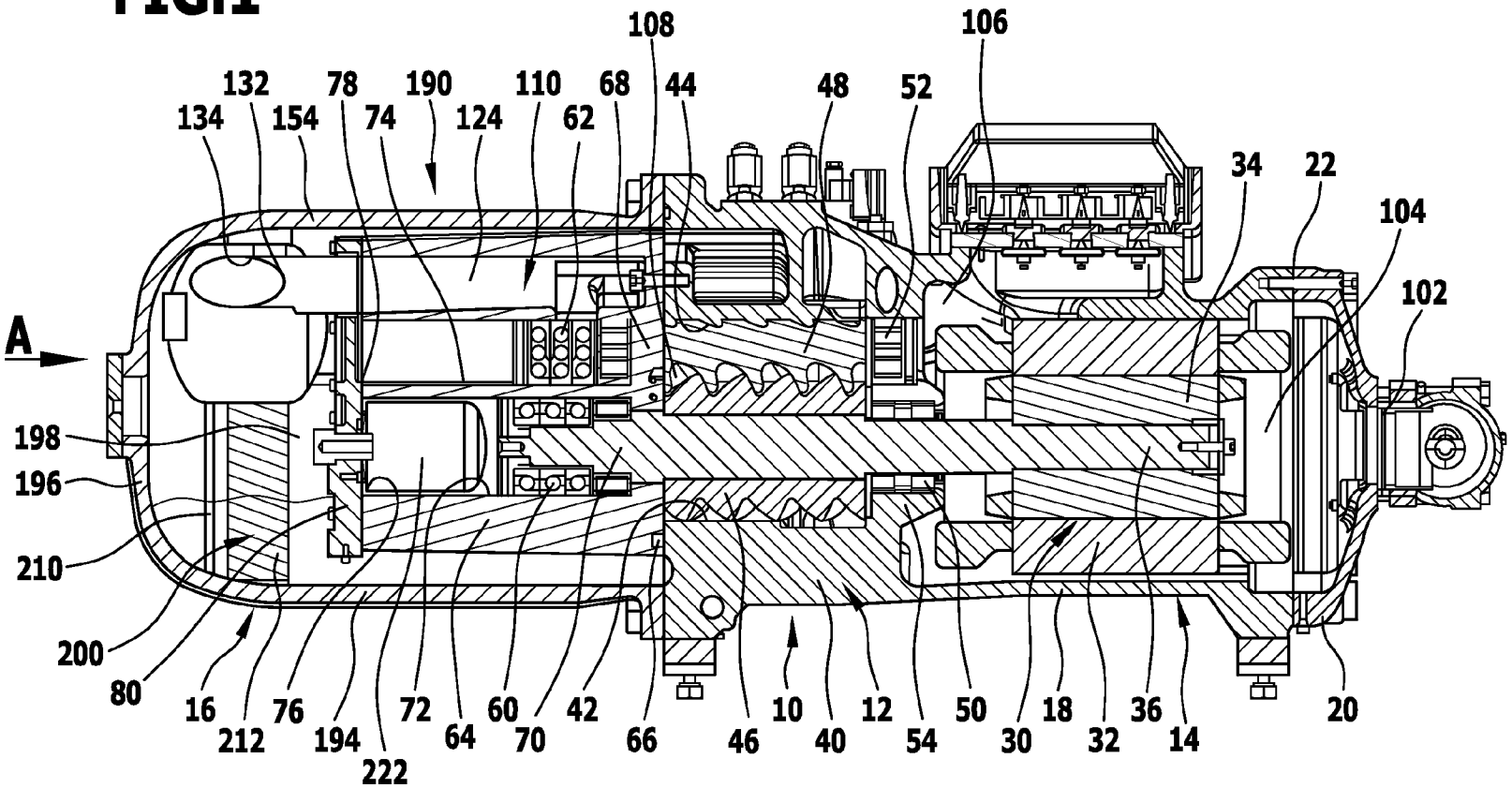
FIG. 1 shows a longitudinal section along line 1-1 in FIG. 3.

One embodiment of a screw compressor according to the invention, illustrated in FIG. 1, comprises an outer housing which is designated as a whole as 10 and consists of a central section 12, an end section 14 on the motor side and an end section 16 on the pressure side.

The end section 14 on the motor side is formed, for example, by a first housing sleeve 18 which is integrally formed on the central section 12 in one piece and is closed by a first housing cover 20 which is detachably connected to the first housing sleeve 18 via a flange connection 22.

A drive motor, which is designated as a whole as 30 and is designed, for example, as an electric motor, is arranged in the end section 14 on the motor side and has a stator 32 which is held in the first housing sleeve 18 and encloses a rotor 34, wherein the rotor 34 is seated on a drive shaft designated as a whole as 36.

A compressor screw housing which is designated as a whole as 40 is provided in the central section 12 of the outer housing 10 and is preferably formed in one piece on the central section 12 and has rotor bores 42 and 44 for accommodating screw rotors 46 and 48 which can be rotated about axes which are parallel to one another. For example, the screw rotor 46 is seated on the drive shaft 36 which extends from the stator 32 and passes through the screw rotor 46.

The rotatable mounting of the screw rotors 46 and 48 is brought about on a side thereof facing the drive motor 30 via first rotary bearings 50 and 52 which are seated in a first bearing housing 54 which is integrally formed on the compressor screw housing 40 in one piece on the side facing the drive motor 30.

Figure 2:
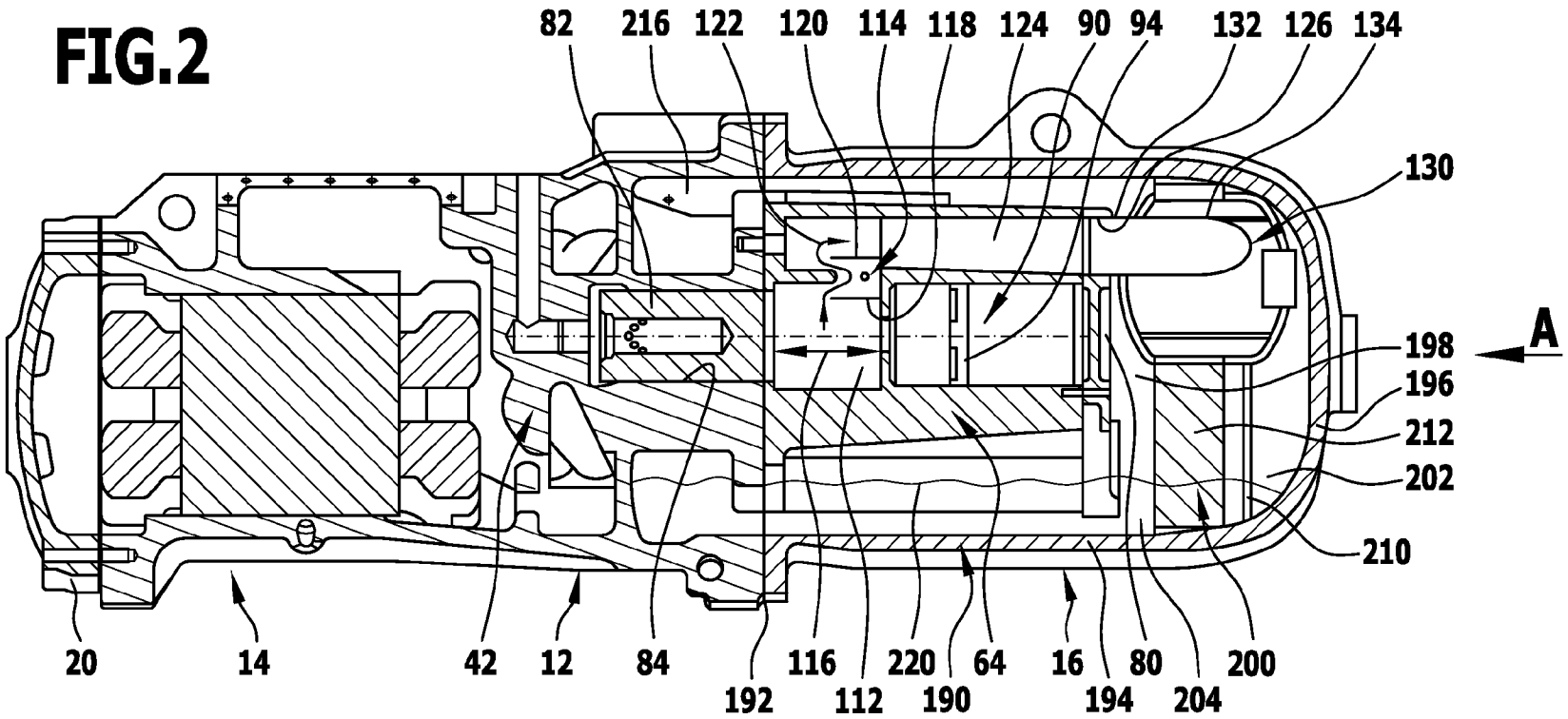
FIG. 2 shows a longitudinal section along line 2-2 in FIG. 3.
Figure 3:
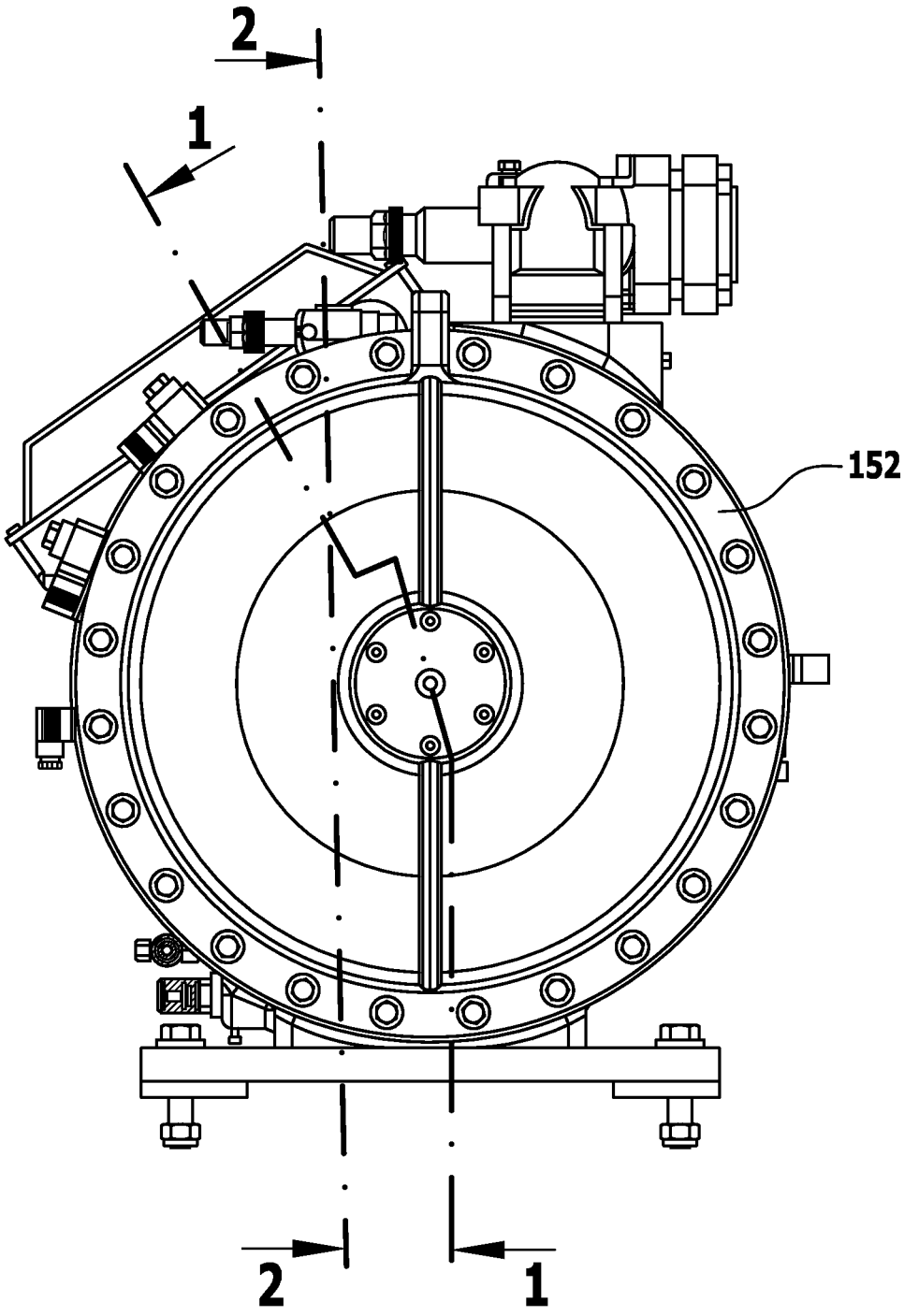
FIG. 3 shows a plan view of the compressor according to the invention in the direction of arrow A in FIGS. 1 to 3.
Figure 4:
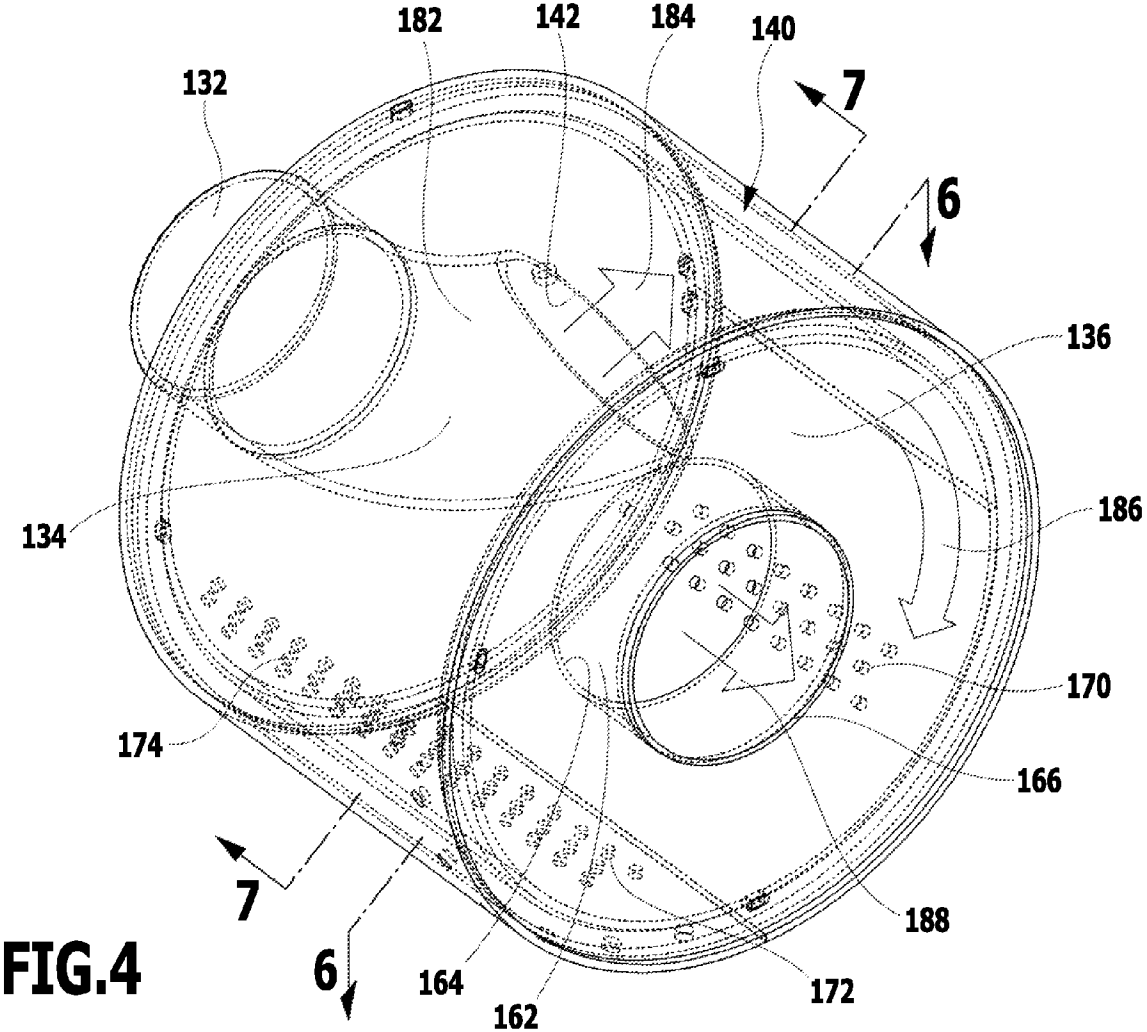
FIG. 4 shows a perspective transparent illustration of the sound damping device according to the invention.

The screw rotors 46 and 48 are mounted on a side facing away from the drive motor 30 via second rotary bearings 60 and 62 which are arranged in a second bearing housing 64 which is detachably held on the compressor screw housing 40 on its side facing away from the drive motor 30 via a flange connection 66 on the compressor screw housing 40, wherein the second bearing housing 64, for its part, also has a wall 68 which closes the rotor bores 42, 44 on the pressure side and merely has shaft stubs, which lead to the second rotary bearings 60 and 62 for the purpose of mounting the screw rotors 46, 48, passing through it, wherein only the shaft stub 70 of the drive shaft 36 is apparent in FIGS. 1 and 2.

The rotary bearings 60 and 62 are preferably seated in bearing recesses 72 and 74 which are provided in the second bearing housing 64 and have, on a side facing away from the compressor screw housing 40, openings 76 and 78 which can be closed by an end cover 80 of the second bearing housing 64, wherein the rotary bearings 60 and 62 can be inserted into the bearing recesses 72 and 74 via the openings 76 and 78.

A control slide 82 is also provided in the compressor screw housing 40 in a slide bore 84 which can be displaced in a direction parallel to the rotary axes of the screw rotors 46 and 48, namely controllable by an adjusting cylinder.

In the screw compressor according to the invention, working medium to be compressed will be supplied via an inlet opening 102 provided in the first housing cover 20 to an inlet chamber 104 which is arranged within the end section 14 on the motor side and in which the electric motor 30 is also arranged so that the electric motor 30 will be cooled by the working medium flowing through the inlet chamber 104.

The working medium flows out of the inlet chamber 104 into an inlet 106 which is provided on a side of the compressor housing 40 facing the drive motor 30 and supplies the working medium to the screw rotors 46 and 48 for the purpose of compression.

The working medium compressed by the screw rotors 46 and 48 will be discharged by the screw rotors 46 and 48 into an outlet 108 in the compressor screw housing 40, which is arranged on a side of the compressor screw housing 40 facing away from the drive motor 30, and from the outlet 108 enters an outlet channel 110 which is arranged in the second bearing housing 64 and is formed, first of all, by a slide receiving device 112 which adjoins the slide bore 84 and which the control slide 82 enters in slide positions which correspond to a lower compressor capacity than the maximum capacity.

The slide receiving device 112 has, in addition, the piston rod passing through it which is guided from the adjusting piston 94 to the control slide 82.

The outlet channel 110 leads from the slide receiving device 112 via an outlet window 114, which is arranged to the side of the slide receiving device 112 and can have compressed working medium flowing through it in a direction transverse to an adjusting direction 116 of the control slide 82, to an outflow channel 124.

The outlet window 114 is preferably provided with flow deflection walls 118 and 120 which are arranged on both sides of it and prevent any direct flow of the compressed working medium transversely to the adjusting direction 116 and force the compressed working medium to flow through the outlet window 114 in the form of a meandering flow path 122 before the compressed working medium enters the outflow channel 124 in the second bearing housing 64 which extends in the direction of the end cover 80, namely to an outflow opening 126 in the end cover 80.

The flow deflection walls 118 and 120 in the region of the outlet window 114 serve the purpose of damping any propagation of strong pressure peaks between the slide receiving device and the outflow channel 124 as a result of the meandering flow path 122.

A sound damping device which is designated as a whole as 130 adjoins the outflow opening 126 and has an inlet connection piece 132 which is part of an inlet pipe 134 which extends into an interior space 136 of a housing 140 of the sound damping device proceeding from the inlet connection piece 132, which engages in the outflow opening 126 in a tightly sealing manner, and has an opening 142 located in the interior space 136.

Figure 5:
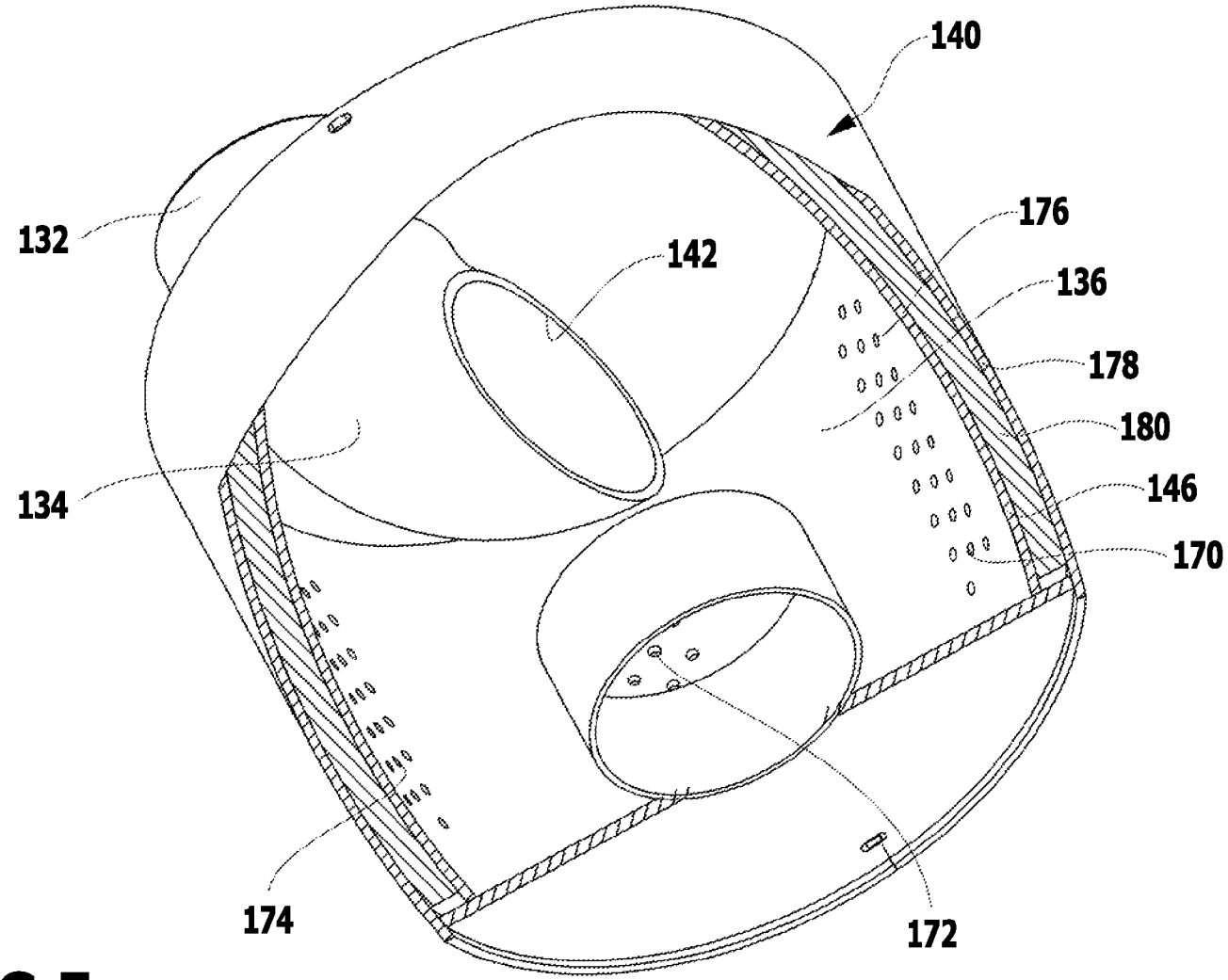
FIG. 5 shows a perspective, partially cutaway illustration of the sound damping device according to the invention.
Figure 6:
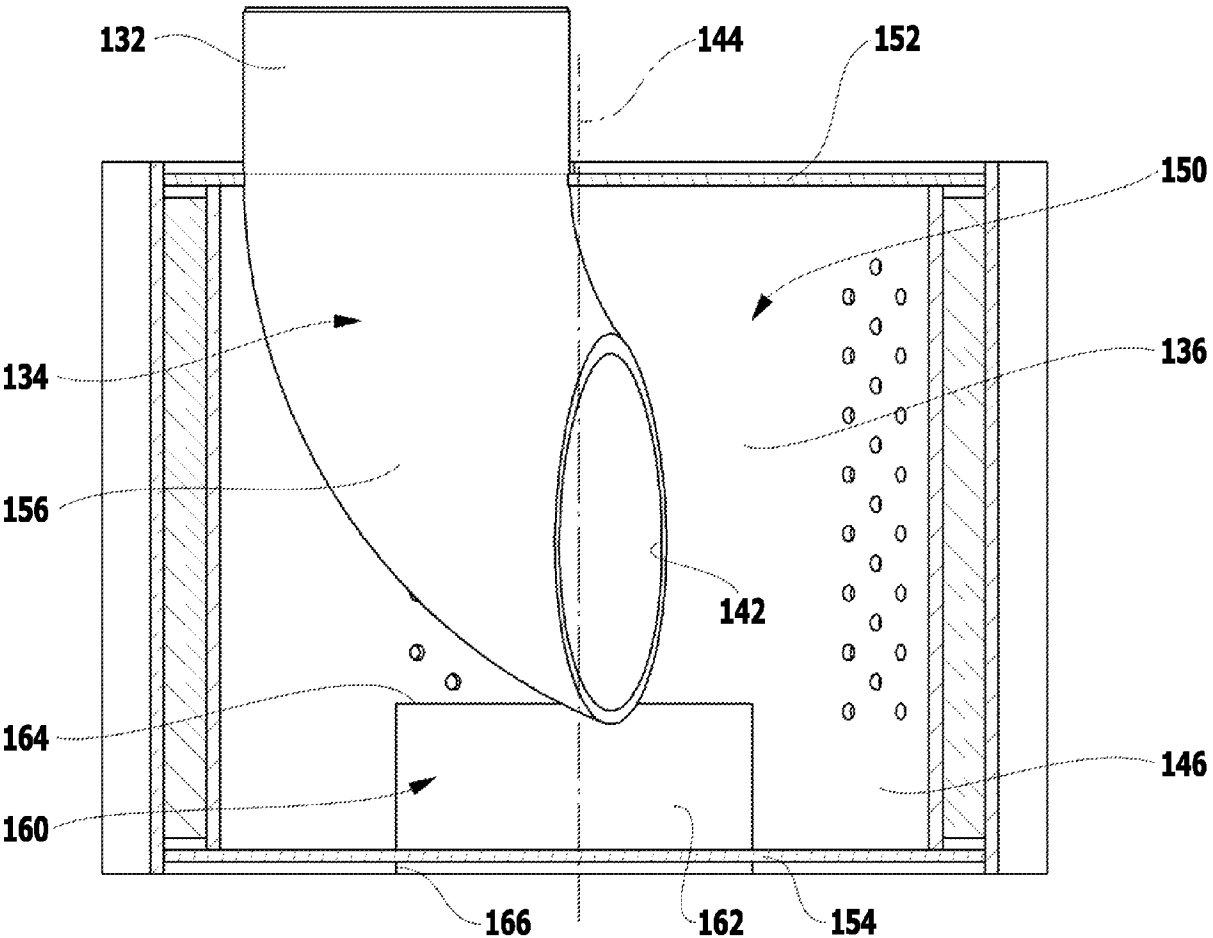
FIG. 6 shows a plan view of a section along line 6-6 of the sound damping device illustrated in FIG. 4

As illustrated, in particular, in FIGS. 5 and 6, the interior space 136 is limited by an inner wall 146 of the housing 140 of the sound damping device which extends preferably cylindrically around a central axis 144 of the housing of the sound damping device and forms a flow guiding element 150, the function of which will be explained in detail in the following.

Furthermore, the interior space 136 is also limited by end walls 152 and 154 which extend transversely to the central axis, wherein the end wall 152 faces the bearing housing 64 and the end wall 154 is arranged on a side facing away from the bearing housing 64.

The end wall 152 has the inlet pipe 134 passing through it which, adjoining the end wall 152, is provided with a curved piece 156 which has at its end the opening 142 which is located approximately in the middle between the end walls 152 and 154 and on one side of the central axis 144, wherein the opening 142 preferably extends in a plane 158 which runs approximately parallel to the central axis 144.

Figure 7:
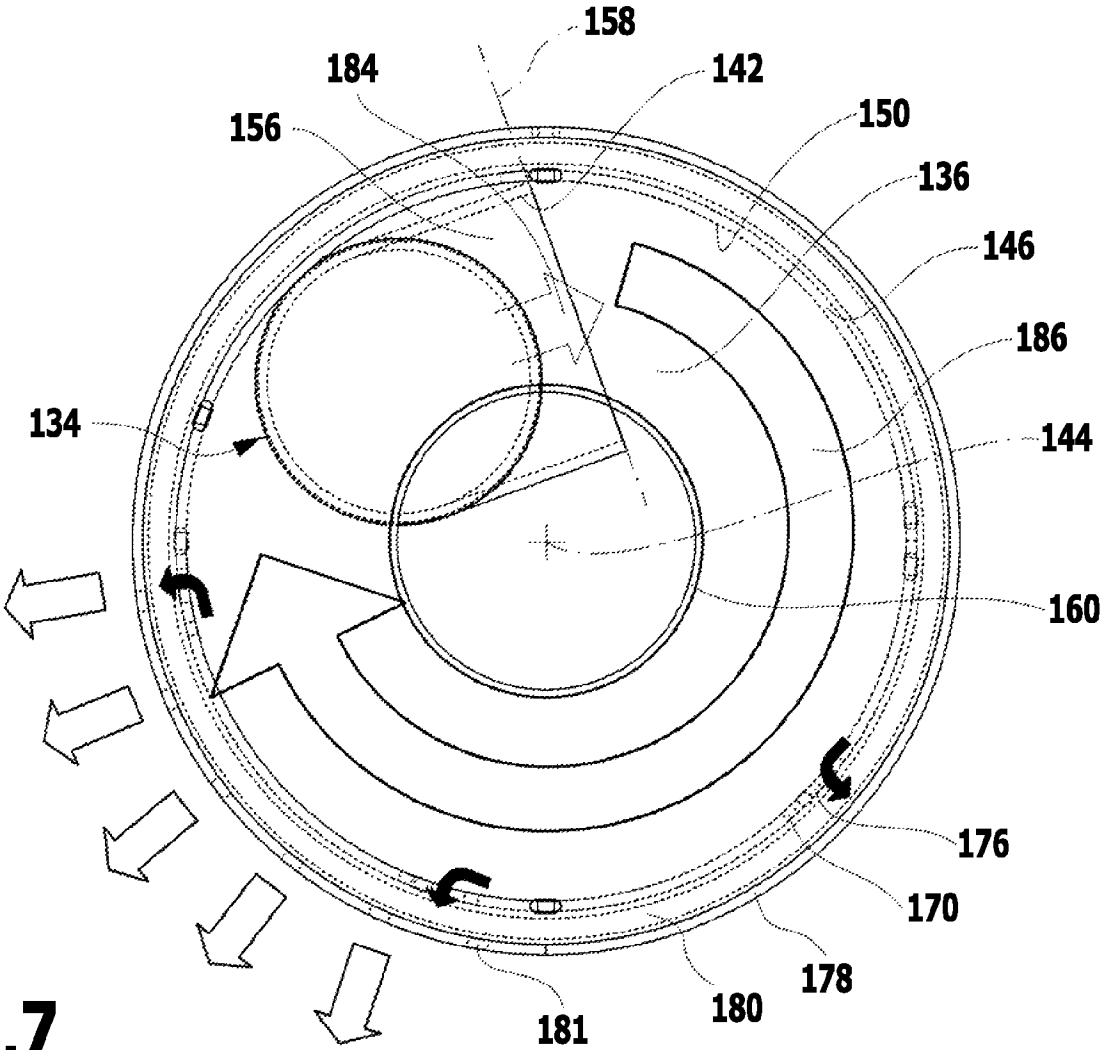
FIG. 7 shows an illustration of the flows in the sound damping device in a section along line 7-7 in FIG. 4.

In particular, the opening 142 directly adjoins the inner wall 146 with its area facing this wall, wherein the inlet connection piece 132 is preferably already arranged in such a manner that after passing through the end wall 152 the inlet pipe 134 runs close to the inner wall 146, preferably extends so as to abut on it (FIG. 7). The jump in the cross section of the sound damping device 130 during the transition from the opening 142 to the interior space 136 is expediently more than a factor of 2, preferably more than a factor of 4.

Furthermore, the sound damping device 130 is provided with an outlet pipe 160 which is seated approximately centrally in the end wall 154, preferably coaxial to the central axis 144, and extends with a pipe section 162 from the end wall 154 into the interior space 136, namely as far as an inner opening 164 which is arranged at a distance from the end wall 154, and has an outer opening 166 which opens into an interior space of the screw compressor housing 10 which encloses the housing 140 of the sound damping device.

The inner wall 146 forming the flow guiding element 150 is provided with several, for example three fields of openings 170, 172 and 174 which have passages 176 arranged in a specific pattern, for example in rows, so that—as will be described in detail in the following—lubricant can pass through the passages 176 of the fields of openings 170, 172 and 174.

The housing 140 of the sound damping device comprises, apart from the inner wall 146, an outer wall 178 which extends at a distance from this inner wall 146 and around it, wherein a material 180 pervious to lubricant, for example a porous material or, in particular, a metal knitted fabric, is arranged in an intermediate space between the outer wall 178 and the inner wall 146 and allows the passage of lubricant which penetrates the passages 176 in the fields of openings 170, 172, 174 and offers the possibility for the lubricant to collect in the material 180 and, as illustrated in FIG. 7, to pass through passages 181 in the outer wall 178 and, therefore, exit from the housing 140 of the sound damping device.

The sound damping device 130 according to the invention operates such that compressed working medium coming from the outflow opening 126 enters the interior space 136 in the form of an inlet flow 184 via an inlet channel 182 formed by the inlet pipe 134 on one side of the central axis 144, namely, in particular, adjoining the flow guiding element 150, and is then guided around the central axis 144 by the flow guiding element 150 in the form of a circulating flow 186 and, in this respect, lubricant is separated at the flow guiding element 150 on account of centrifugal forces. The circulating flow 186 increasingly loses lubricant after several circuits around the central axis 144 and then moves increasingly radially inwards in the direction of the central axis 144 in order to then leave the interior space 136 approximately parallel to the central axis 144 in the form of an outlet flow 188 via the outlet pipe 160 and to exit to the surroundings of the sound damping device 130 via the outer opening 166.

On account of the jump in cross section at the opening 142 of the inlet pipe 134 relative to the interior space 136 and the jumps in cross section from the interior space 136 to the inner opening 164 and from the outer opening 166 of the outlet pipe 160 to the surroundings of the sound damping device 130 which are respectively greater than a factor of 2, a sound damping effect occurs which is combined, in the case of the sound damping device 130 according to the invention, with a separation of lubricant in the interior chamber 136 on account of the centrifugal force, wherein the lubricant has the possibility of passing through the flow guiding element 150 in the region of the fields of openings 170, 172 and 174, of collecting in the material 180 and of flowing along this material in order to exit via the passages 181 in the outer wall 178 of the housing 140 of the sound damping device.

In this respect, the small cross sections of the passages 176 in the fields of openings 170 to 174 and the porosity of the material 180 essentially keep the working medium back and so the working medium itself leaves the sound damping device 130 essentially in the form of the outlet flow 188 and passes through the passages 176 in the fields of openings 170 to 174 and the material 180 only in the form of a small parasitic portion and exits through the passages 181 in the outer wall 178.

The fields of openings 170 to 174 are arranged relative to one another in circumferential direction of the circulating flow 196 at an angular distance with respect to the central axis 144, namely such that the first field of openings 170 is at an angular distance from the opening 142 of the inlet pipe 134 of more than 140° and an angular distance between consecutive fields of openings 170, 172, 174 is at least 30°.

All the fields of openings 170, 172 and 174 are also preferably arranged in that half of the inner wall 146 which forms the lower half of the inner wall 146 with respect to the direction of the force of gravity.

The end section 16 of the screw compressor housing 10 on the pressure side is formed in the embodiment illustrated by a housing capsule 190 which is connected to the central section 12 with a flange connection 192 and, proceeding from the central section, extends away from it on a side located opposite the drive motor 30 with a capsule sleeve 194 which outwardly encloses not only the second bearing housing 64 but also the sound damping device 130 and which is closed with a capsule base 196 on a side located opposite the flange connection 192.

The housing capsule 190 encloses an interior space 198 which has the compressed working medium passing through it and in which the second bearing housing 64 and the sound damping device 130 are arranged, wherein the interior space 198 is subdivided by an additional lubricant separator 200, which extends approximately parallel to the capsule base 196 and to the end cover 80, into a distribution chamber 202, which is located between the lubricant separator 200 and the capsule base 196 and which the outlet flow 188 enters through the outer opening 164, and a flow-off chamber 204 which is located between the lubricant separator 200 and the compressor screw housing 40.

As illustrated in detail in FIGS. 1 and 2, the lubricant separator 200 comprises a supporting element 210 in the form of a perforated sheet which, for its part, has the sound damping device 130 passing through it and supports the sound damping device 130 in the region of its housing 140.

The supporting element 210 is, for its part, connected rigidly to the bearing housing 64, in particular the end cover 80 thereof, via stud bolts.

In addition, the additional lubricant separator 200 comprises a bearing 212 which is held in position by the supporting element 210 and consists of a knitted, interlaced or woven fabric consisting of metal or plastic which has the task of combining oil mist still carried along in the outlet flow 188 of the compressed working medium to form drops and, therefore, to contribute to the separation of oil from the compressed working medium.

Lubricant drops are, therefore, already formed during the course of its flow through the lubricant separator 200 and these drops are either already precipitated in the lubricant separator 200 itself in the direction of the force of gravity and collected following the direction of the force of gravity or are likewise precipitated out of the compressed working medium on account of the force of gravity after flowing through the oil separator.

In the solution according to the invention, the sound damping device 130 is arranged such that it penetrates the lubricant separator 200, wherein the inlet connection piece 132 is located on the one side of the lubricant separator 200 and is surrounded by the flow-off chamber 204 while the outer opening 164 of the outlet pipe 160 and the passages 181 open into the distribution chamber 202, in which the outlet flow 188 of the compressed working medium is distributed with a jump in cross section of more than a factor 2 over a large flow cross section which corresponds essentially to an inner cross section of the capsule sleeve 194 less the cross sectional surface area required by the sound damping device 130 when penetrating the lubricant separator 200 and so the compressed working medium can flow through the lubricant separator 200 with a large flow cross section in the direction of the flow-off chamber 204 in order to be supplied from the flow-off chamber 204 to an outlet chamber 216 which is provided in the region of the central section 12, engages around the compressor screw housing 40 at least partially and leads to an outlet opening provided in the outer housing 10.

The lubricant separated in the sound damping device 130 and in the additional lubricant separator 200 is collected in the form of a lubricant sump 220 which extends over a lower area of the distribution chamber 192, a lower area of the flow-off chamber 204 and a lower area of the outlet chamber 216.

The lubricant is taken up from the lubricant sump 220 and filtered through an oil filter 222 which is arranged in the bearing recess 72 of the second bearing housing 64 for the purpose of saving on space.

The invention claimed is:

1. Screw compressor comprising an outer housing, a compressor screw housing arranged in the outer housing, rotor bores for screw rotors being arranged in said compressor screw housing, a drive arranged in the outer housing on a side of the compressor screw housing located opposite the drive, a bearing housing arranged in the outer housing on a side of the compressor screw housing located opposite the drive, and a sound damping device arranged within the outer housing in a first interior space, the first interior space being an interior space of said outer housing, the compressed working medium flowing through the sound damping device and when exiting from said sound damping device entering said first interior space of said outer housing, the sound damping device guiding the compressed working medium by means of a flow guide, the flow guide enclosing a second interior space, the second interior space being an internal space of said sound damping device, the compressed working medium being guided as a circulating flow circulating around an axis and wherein lubricant is separated from the circulating flow of the working medium as a result of centrifugal forces being in the area of the flow guide, the flow guide comprising an inner wall surface enclosing the second interior space, the separation of lubricant taking place at said inner wall surface, the flow guide having openings for the lubricant, the flow guide being covered with a material pervious to lubricant in the area of the openings on an exterior wall surface of the flow guide, the exterior wall surface being on an opposite side of flow guide relative to the inner wall surface, the material pervious to lubricant is a material preventing any working medium flowing through.

2. Screw compressor as defined in claim 1, wherein the openings are arranged in individual areas of the flow guide.

3. Screw compressor as defined in claim 1, wherein the openings are arranged in the flow guide in the form of at least one field of openings.

4. Screw compressor as defined in claim 3, wherein the flow guide is provided with at least two fields of openings.

5. Screw compressor as defined in claim 4, wherein the fields of openings are arranged so as to follow one another in circumferential direction of the circulating flow.

6. Screw compressor as defined in claim 1, wherein the material pervious to lubricant is a fiber material.

7. Screw compressor as defined in claim 1, wherein the material pervious to lubricant is covered by an outer wall of the sound damping device.

8. Screw compressor as defined in claim 7, wherein the outer wall is arranged at a distance from the flow guide and the material pervious to lubricant is arranged in the intermediate space between flow guide and the outer wall.

9. Screw compressor as defined in claim 7, wherein the outer wall is provided with passages for the lubricant.

10. Screw compressor as defined in claim 7, wherein the material pervious to lubricant is intermediate between the flow guide and the outer wall.

11. The screw compressor of claim 10 wherein the material pervious to lubricant contacts both the exterior wall surface of the flow guide and the outer wall.

12. Screw compressor as defined in claim 1, wherein in the sound damping device an inlet flow enters transversely to the axis.

13. Screw compressor as defined in claim 12, wherein the sound damping device has an inlet channel allowing the working medium to enter the second interior space in the form of the inlet flow running transversely to the axis.

14. Screw compressor as defined in claim 13, wherein the inlet channel has a section extending approximately in the direction of the axis in an inlet connection piece of an inlet pipe.

15. Screw compressor as defined in claim 13, wherein the inlet channel extends in a curved manner in an arc of the inlet pipe.

16. Screw compressor as defined in claim 13, wherein the inlet channel is arranged outside a central area of the second interior space.

17. Screw compressor as defined in claim 1, wherein the working medium exits from the sound damping device in the form of an outlet flow running approximately in the direction of the axis.

18. Screw compressor as defined in claim 17, wherein the outlet flow passes through an outlet pipe of the sound damping device.

19. Screw compressor as defined in claim 18, wherein the outlet pipe is arranged in a central area relative to the flow guide.

20. Screw compressor of claim 1 wherein the material pervious to lubricant is in surrounding relation to the flow guide wherein lubricant exiting the second interior space passes first through the openings to reach the material pervious to lubricant.

* * * * *

UNITED STATES PATENT AND TRADEMARK OFFICE

CERTIFICATE OF CORRECTION

PATENT NO. : 8,500,424 B2
APPLICATION NO. : 13/015736
DATED : August 6, 2013
INVENTOR(S) : Klaus Feller et al.

It is certified that error appears in the above-identified patent and that said Letters Patent is hereby corrected as shown below:

On the title page

(73) Assignee should read: Bitzer Kuehlmaschinenbau GmbH, Sindelfingen (DE)

Signed and Sealed this
Nineteenth Day of November, 2013

Teresa Stanek Rea
*Deputy Director of the United States Patent and Trademark Office*